US005941725A

United States Patent [19]

Brennan et al.

[11] Patent Number: 5,941,725

[45] Date of Patent: Aug. 24, 1999

[54] SHIELDED ELECTRICAL CONNECTOR WITH LATCHING MECHANISM

[75] Inventors: Denise Brennan, Ballylehane; Fearghal Hennessy, Cratloekeel; Tony Mahon, Rosschill; Matthew Wilhite, Ballyclough, all of Ireland

[73] Assignee: Molex Incorporated, Lisle, Ill.

[21] Appl. No.: 08/905,036

[22] Filed: Aug. 1, 1997

[51] Int. Cl.[6] ..... H01R 13/627

[52] U.S. Cl. ..... 439/357; 439/607

[58] Field of Search ..... 439/352–358, 439/607, 610, 701

[56] References Cited

U.S. PATENT DOCUMENTS

| | | | |
|---|---|---|---|
| 5,277,627 | 1/1994 | Matsuzaki | 439/677 |
| 5,306,196 | 4/1994 | Hashiguchi | 439/607 |
| 5,380,223 | 1/1995 | Marsh et al. | 439/610 |
| 5,480,327 | 1/1996 | Zola | 439/607 |
| 5,545,052 | 8/1996 | Hirai | 439/354 |
| 5,547,397 | 8/1996 | Hirai | 439/607 |
| 5,580,268 | 12/1996 | Miyazawa | 439/352 |
| 5,609,499 | 3/1997 | Tan et al. | 439/445 |

*Primary Examiner*—Khiem Nguyen
*Attorney, Agent, or Firm*—Stacey E. Caldwell

[57] ABSTRACT

An electrical connector includes an inner dielectric housing adapted for mounting a plurality of electrical contacts and including a forwardly projecting mating portion. A metallic shield surrounds the housing and includes a generally L-shaped resilient latching mechanism at the front of the shield outside the mating portion. The L-shaped latching mechanism includes a front-to-rear first leg along the mating portion and a transverse second leg projecting outwardly of the mating portion. The first leg has an outwardly projecting latch portion. An outer dielectric cover includes an actuator for engaging the second leg of the L-shaped latching mechanism to urge the first leg and its latch portion inwardly toward the mating portion of the housing.

23 Claims, 7 Drawing Sheets

SHIELDED ELECTRICAL CONNECTOR WITH LATCHING MECHANISM

FIELD OF THE INVENTION

This invention generally relates to the art of electrical connectors and, particularly, to a shielded electrical connector wherein the shield, itself, provides means for latching the connector to a complementary mating connecting device.

BACKGROUND OF THE INVENTION

In high speed and other telecommunication and computer applications, it is important to shield the signals at a connection interface to prevent the ingress and egress of radiated emissions. Accordingly, shielded input-output (I/O) connectors have been used at connection interfaces between computers and telecommunication networks. One type of shielded I/O connector is in the form of a low-profile I/O connector adapted for mating with a connector on the back side of a PCMCIA style memory card. However, these types of connectors have had a variety of problems. First, the shield is difficult to locate and lock onto the connector housing. If the shield is not fixed securely to the underlying housing, a loose fit is created which can result in problems with mating the connector to a complementary connecting device, such as to an accessory (e.g., a phone or computer connector).

Other problems involve such structural deficiencies as known shielded I/O connectors having open fronts which allow a user to tamper with the interior components of the connector, which can lead to damage or failure of the entire connecting system. In addition, lack of support and/or securement of a circuit substrate within the connector can cause inoperation of the system due to breakage or damage of the components. Still further, in known connector assemblies, some latching mechanisms have been provided by the stamped and formed connector shield and actuated by levers integral with or separate from an outer cover. These stamped and formed latching mechanisms can be destroyed if excessive force is applied to the latches and/or levers, thus rendering the latching mechanism inoperative. Similarly, the exposed plastic levers on the outer cover can be damaged or broken by excessive pulling forces in an outward direction.

The present invention is directed to solving one or more of the above myriad of interrelated problems presently occurring in shielded connectors of the character described.

SUMMARY OF THE INVENTION

An object, therefore, of the invention is to provide a new and improved electrical connector, particularly a shielded connector having a latching mechanism integral with the shield.

In the exemplary embodiment of the invention, the connector includes an inner dielectric housing adapted for mounting a plurality of electrical contacts and including a forwardly projecting mating portion having opposite sides. A metallic shield surrounds a major portion of the inner dielectric housing and is formed by a pair of split shield halves. One of the shield halves includes a generally L-shaped resilient latching mechanism at the front of the shield outside each opposite side of the mating portion of the inner dielectric housing. Each of the L-shaped latching mechanisms includes a front-to-rear first leg along a respective side of the mating portion and a transverse leg projecting outwardly of the mating portion. The first leg has an outwardly projecting latch portion. An outer dielectric cover surrounds a major portion of the metallic shield and includes a pair of actuators for engaging the second legs of the L-shaped latching mechanisms to urge the first legs and their latch portions inwardly toward each other and toward the mating portion of the inner dielectric housing.

As disclosed herein, the outer dielectric cover is a unitary molded structure with the actuators being integral therewith. The cover has a front opening significantly larger than the mating portion of the inner dielectric housing, and the housing has front walls projecting transversely outwardly of the mating portion to substantially close the front opening. The transverse second legs of the L-shaped latching mechanisms are confined for movement in slots behind the front walls of the inner dielectric housing.

The front-to-rear first leg of each L-shaped latching mechanism is reverse bent to overlie a third leg secured to a respective side of the mating portion of the inner dielectric housing. The opposite sides of the mating portion have recesses within which the third legs of the latching mechanisms are nested. The third legs have securing openings for receiving securing bosses projecting outwardly from the opposite sides of the mating portion.

Lastly, the transverse second leg of each L-shaped latching mechanism includes a hooked distal end for engagement by one of the actuators of the outer dielectric cover. The hooked distal end is engageable with a portion of the shield to prevent over-stressing the respective latching mechanism when the actuator urges the mechanism inwardly.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
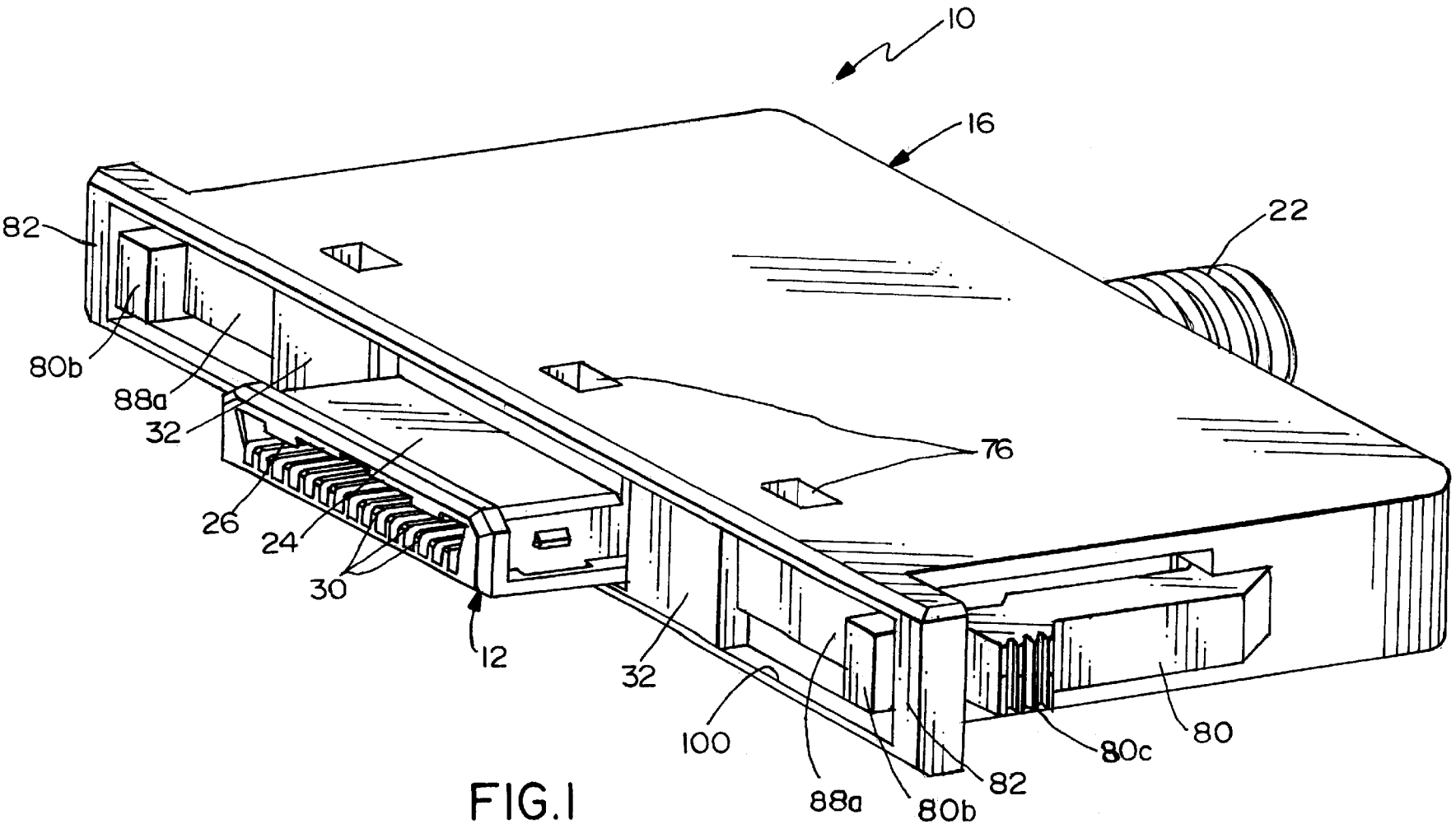
FIG. 1 is a perspective view of the electrical connector of the invention.
Figure 2:
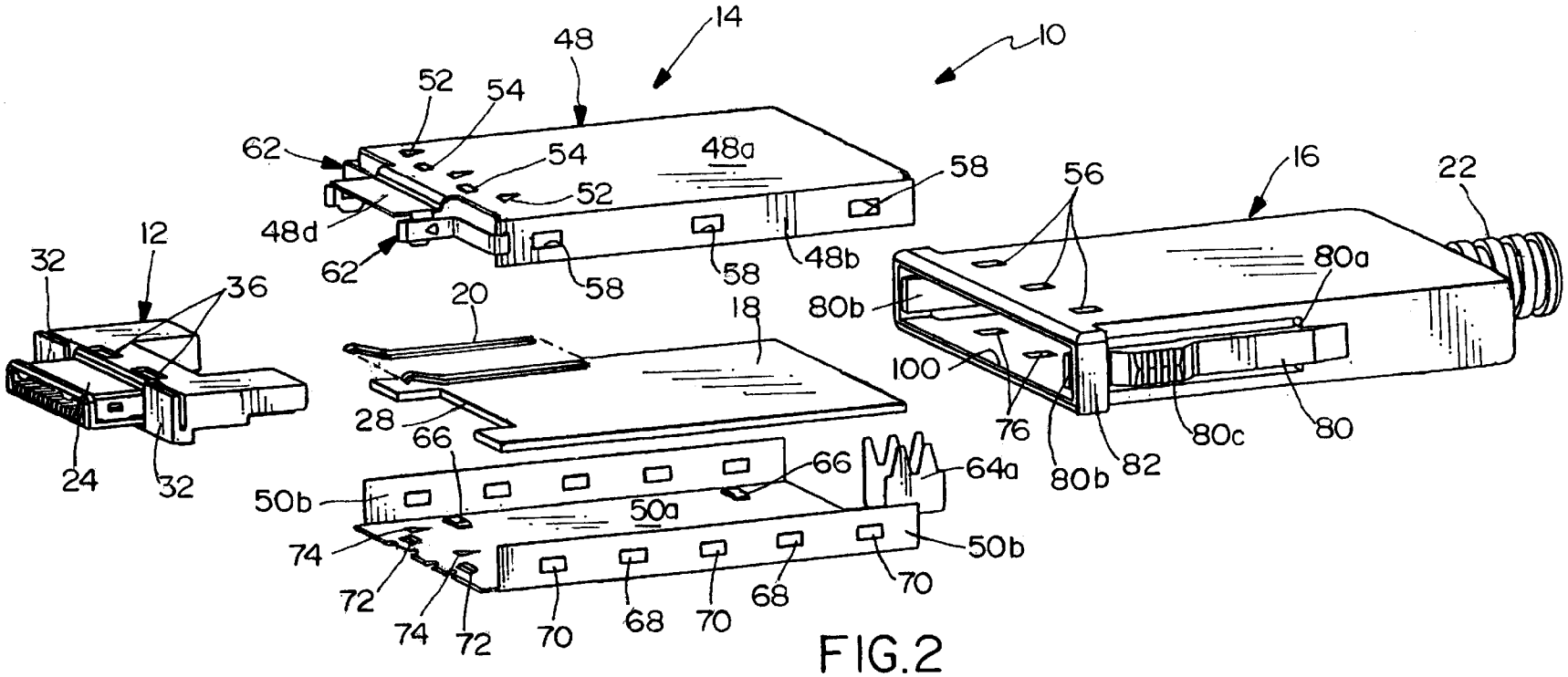
FIG. 2 is an exploded perspective view of the various components of the connector.

Referring to the drawings in greater detail, and first to FIGS. 1 and 2, the invention is embodied in an electrical connector, generally designated 10, which is an input/output (I/O) shielded connector specifically adapted for mating with a complementary connector on the back side of a PCMCIA style memory card. Therefore, as can be seen in the drawings, the connector is of a very low profile.

However, it should be understood that various features of the invention are equally applicable for other types of connectors, as will be fully understandable from the following detailed description.

Generally, as best seen in FIG. 2, connector 10 includes an inner dielectric housing, generally designated 12; a metallic shield, generally designated 14, surrounding a major portion of the inner dielectric housing; and an outer dielectric cover, generally designated 16, substantially surrounding the metallic shield and, therefore, a major portion of the inner dielectric housing. This assembly houses a printed circuit board 18. A plurality of signal contacts 20 are mounted in housing 12 and are secured to circuit traces on the printed circuit board, as by soldering. An electrical cable (not shown) extends through a rear boot portion 22 of outer cover 16 and includes a plurality of conductors appropriately secured to the circuit traces on the printed circuit board, as by soldering. Therefore, signal contacts 20 are electrically coupled to the conductors of the electrical cable through printed circuit board 18.

Figure 3:
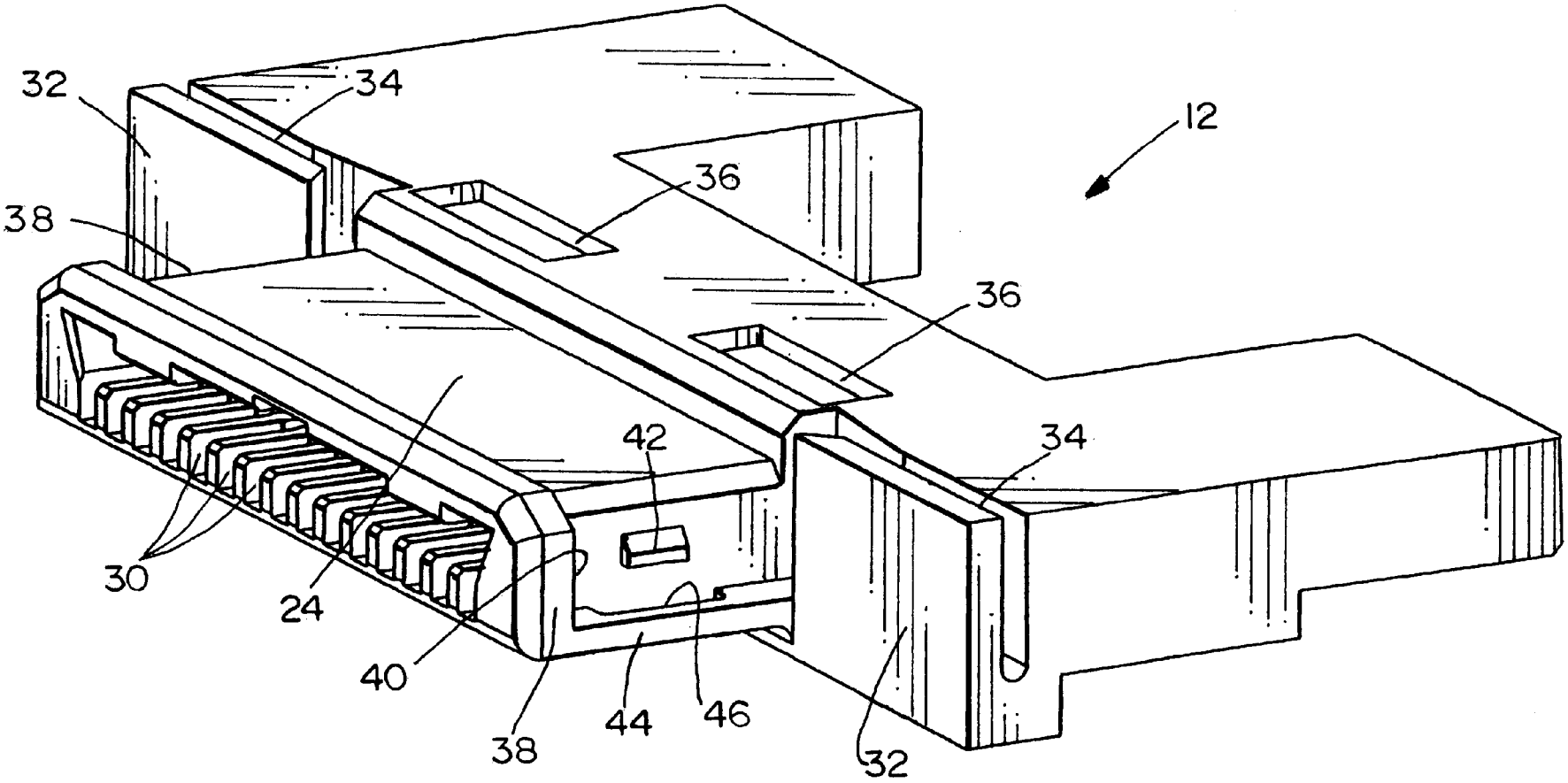
FIG. 3 is a perspective view of the inner dielectric housing of the connector.

Referring to FIG. 3 in conjunction with FIGS. 1 and 2, it can be seen that inner dielectric housing 12 is a low profile component. The housing is a one-piece structure unitarily molded of dielectric material such as plastic or the like. The housing has a forwardly projecting mating portion 24 provided with a narrow slot 26 for receiving a plug portion of the complementary mating connector mounted to the back side of the memory card. The housing is mounted within a recess 28 (FIG. 2) of printed circuit board 18, and signal contacts 20 project into grooves 30 (FIG. 3) within slot 26 for electrical engagement with contacts of the mating connector. The housing has front walls 32 projecting outwardly from opposite sides of mating portion 24, with slots 34 behind the front walls, all for purposes to be described hereinafter. Both the top and the bottom of the housing are provided with a pair of recesses 36 for securing the shield thereto, as will be described hereinafter.

Finally, as best seen in FIG. 3, forwardly projecting mating portion 24 of housing 12 has opposite sides 38 which are recessed, as at 40 for accommodating latching mechanisms described hereinafter. A latching boss 42 is molded integrally with the housing within each recess 40, and a bottom ledge 44 of the recess is provided with a through passage 46.

Figure 4:
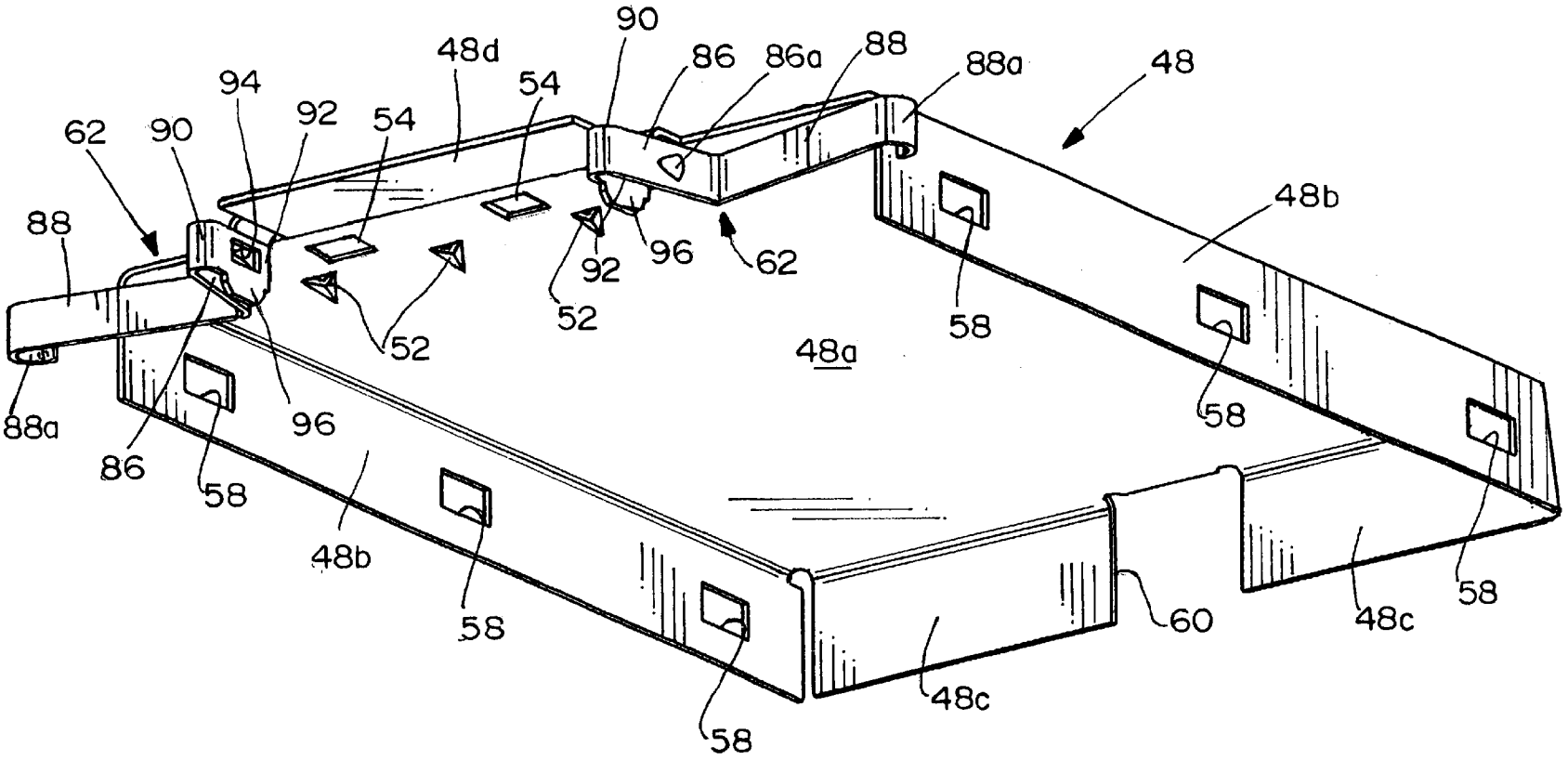
FIG. 4 is a perspective view of the upper shield half of the connector.
Figure 5:
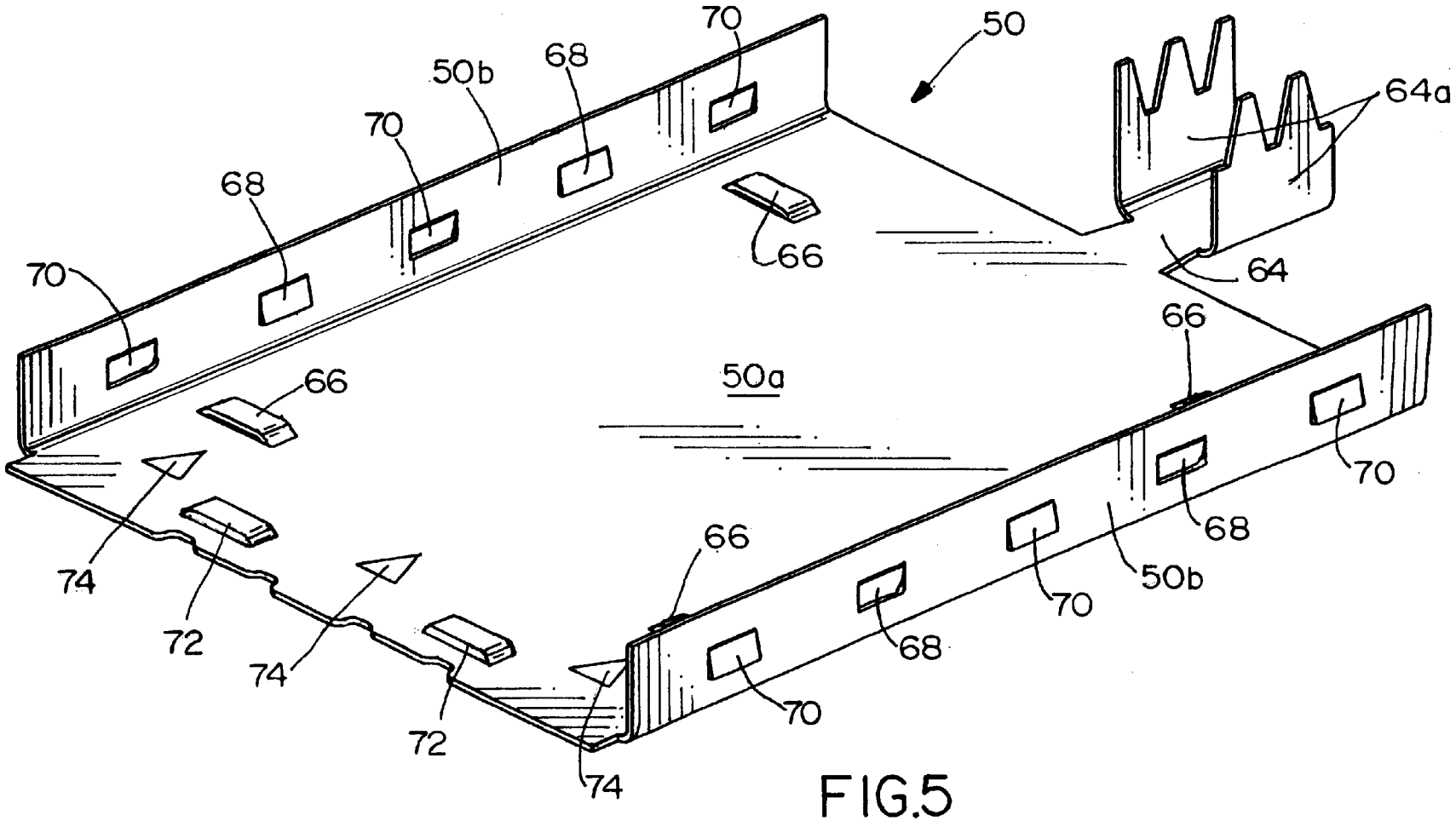
FIG. 5 is a perspective view of the lower shield half of the connector.

Referring to FIGS. 4 and 5 in conjunction with FIGS. 1 and 2, shield 14 is formed by a pair of split shield halves, namely an upper shield half, generally designated 48, and a lower shield half, generally designated 50. Each shield half is stamped and formed of sheet metal material as a one-piece structure.

Referring first to FIG. 4, upper shield half 48 includes a top wall 48*a*, a pair of side walls 48*b*, a pair of split rear walls 48*c* and a forwardly projecting lip 48*d* which is generally parallel to top wall 48*a*. Top wall 48*a* has a pair of inwardly directed projections 52 for securement within recesses 36 (FIG. 3) in the top of housing 12 and three outwardly directed projections 54 for securement in three holes 56 (FIG. 2) in the top of outer cover 16. Side walls 48*b* each have three detent openings 58 for snapping engagement with lower shield half 50, as described hereinafter. Rear walls 48*c* define an opening 60 therebetween to allow for passage of the electrical cable therethrough. Front lip 48*d* is sized and configured for overlying the top of forwardly projecting mating portion 24 of housing 12. Finally, upper shield half 48 has a generally L-shaped resilient latching mechanism, generally designated 62, at the front of the shield outside each opposite side 38 of mating portion 24 of the inner dielectric housing. The latching mechanisms will be described in greater detail hereinafter in conjunction with FIG. 7.

Referring to FIG. 5 in conjunction with FIGS. 2–4, lower shield half 50 has a bottom wall 50*a* and a pair of side walls 50*b*. The bottom wall has a rearwardly projecting tongue 64 provided with a pair of crimp arms 64*a* for clamping onto the electrical cable. Four platforms 66 are struck out of the sheet metal of the bottom wall and onto which printed circuit board 18 (FIG. 2) rests. A pair of inwardly directed hook projections 68 are struck from each side wall 50*b* for engaging the top side edges of the printed circuit board. Therefore, the printed circuit board can be snappingly mounted within lower shield half 50 onto the top of platforms 66 as hook projections 68 snappingly engage the top side edges of the board. Side walls 50*b* of the lower shield half each have three outwardly directed hook projections 70 which snappingly engage within detent openings 58 in side walls 48*b* of the upper shield half to hold the shield halves together as an enclosure. Finally, bottom wall 50*a* has a pair of inwardly directed projections 72 for securement within recesses 36 (FIG. 3) at the bottom of housing 12 and three outwardly directed projections 74 for securing within holes 76 (FIG. 2) in the bottom of outer cover 16.

Figure 6:
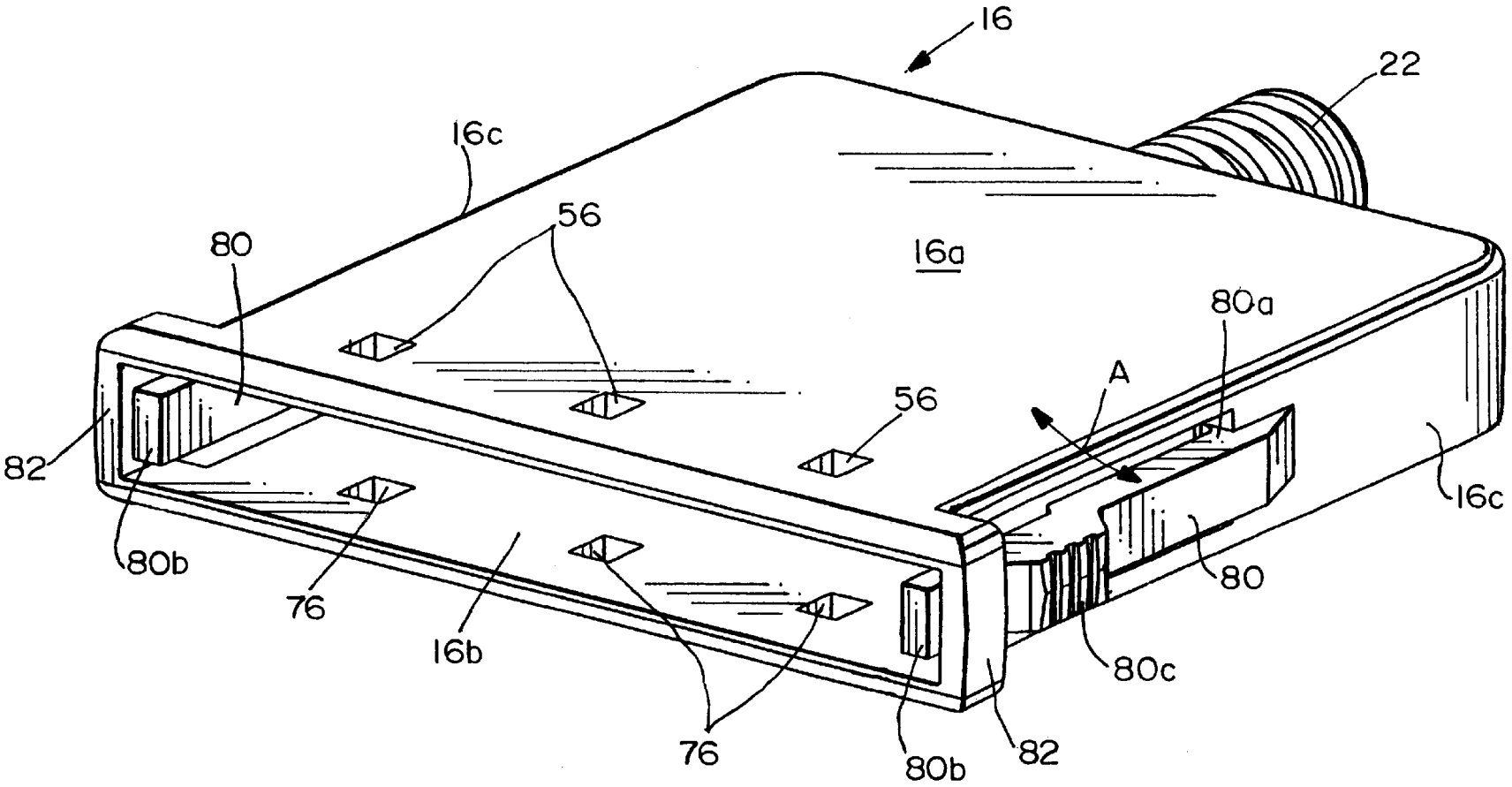
FIG. 6 is a perspective view of the outer dielectric cover of the connector.

Referring to FIG. 6 is conjunction with FIGS. 1–5, outer dielectric cover 16 has top and bottom walls 16*a* and 16*b*, respectively, provided with holes 56 and 76, respectively, for receiving outwardly directed projections 52 and 74 of upper and lower shield halves 14 and 50, respectively. The outer cover is a one-piece structure unitarily molded of dielectric material such as plastic or the like, and boot 22 for the electrical cable is molded integrally therewith and projects rearwardly therefrom.

Outer dielectric cover 16 (FIG. 6) has side walls 16*c* integrally joining top and bottom walls 16*a* and 16*b*, respectively. A cantilevered actuator arm 80 is molded integrally with each side wall 16*c*. A rear end 80*a* of each actuator arm is integral with the respective side wall so that a distal end 80*b* of the actuator arm is pivotally movable in the direction of double-headed arrow "A" (FIG. 6). A raised serrated boss 80*c* is provided on each actuator arm for engagement by an operator's thumb or finger. The front distal end 80*b* of each actuator arm projects forwardly behind a bridge 82 to prevent the actuator arms from being excessively pulled outwardly which might damage or break the arms.

Figure 7:
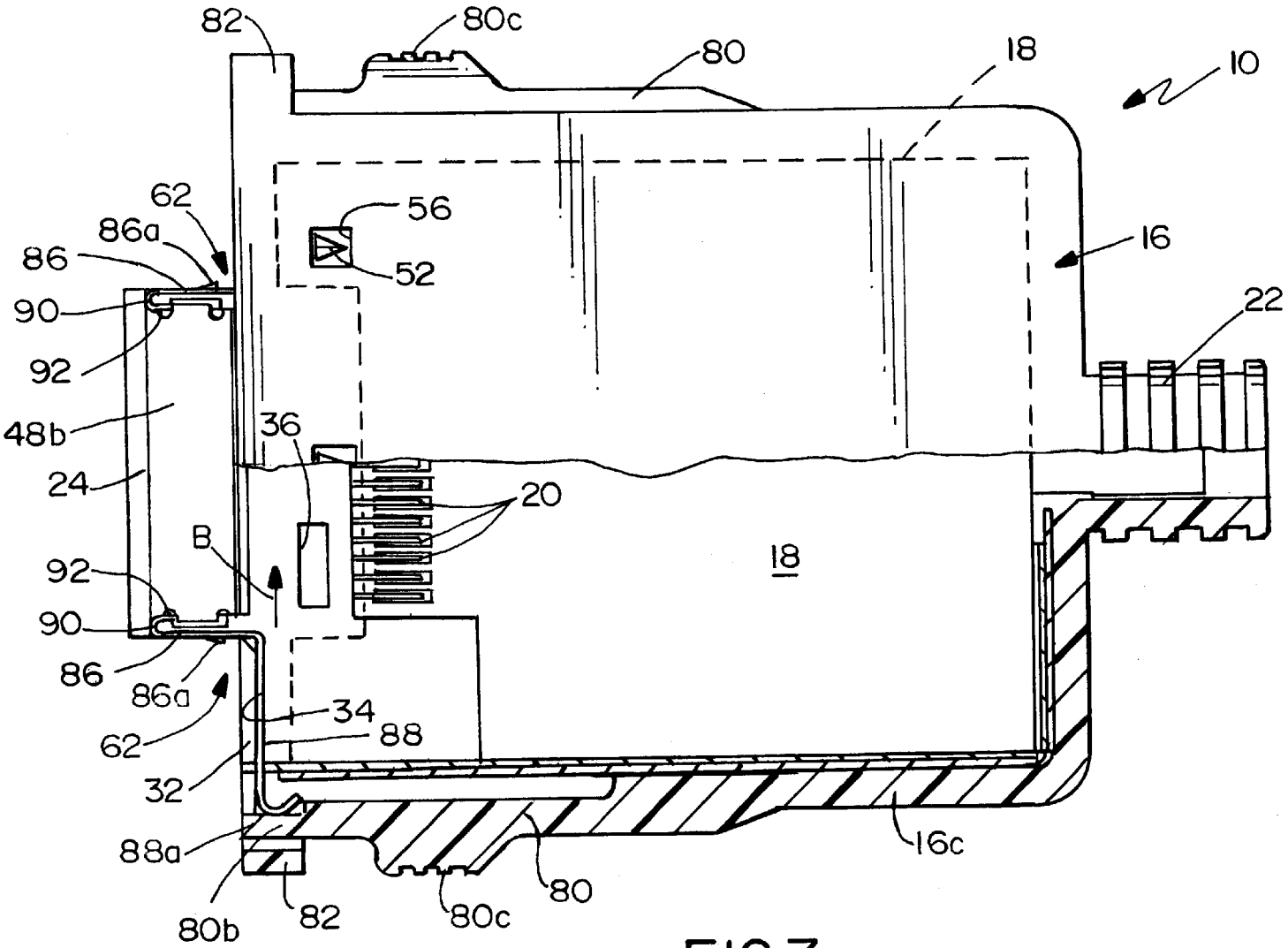
FIG. 7 is a top plan view of the connector, with the bottom half of the depiction in a horizontal section.

Referring to FIG. 7 particularly in conjunction with FIG. 4, each L-shaped latching mechanism 62 includes a front-to-rear first leg 86 along a respective side of forwardly projecting mating portion 24 of the inner housing, and a transverse second leg 88 projecting outwardly of the mating portion. Front-to-rear first leg 86 has an outwardly projecting latch portion 86*a*, and transverse second leg 88 has a hooked distal end 88*a*. Latch portion 86*a* is adapted for engagement with an appropriate latch means of the complementary mating connector. Hooked distal end 88*a* is positioned as best seen in FIG. 7 for engagement by distal end 80*b* of actuator arm 80 so that the actuator arm can urge first leg 86 and latch portion 86*a* inwardly toward mating portion 24 in the direction of arrow "B" to unlatch and unmate connector 10 from the mating connector. It can be seen that transverse second leg 88 of each latching mechanism is confined for movement within slot 34 behind one of the front walls 32 of the inner dielectric housing. It can be understood from FIG. 7 that hooked distal ends 88*a* of the transverse legs of the latching mechanisms will engage with the outsides of the shield halves to prevent over-stressing the latching mechanisms when the actuator arms urge the mechanisms inwardly.

As best seen in FIGS. 4 and 7, the front-to-rear first leg 86 of each latching mechanism 62 is reverse bent, as at 90, to overlie a third leg 92 which is secured to a respective side 38 (FIG. 3) of inner dielectric housing 12. More particularly, third leg 92 nests within the recess 40 (FIG. 3) at the respective side of the mating portion, and the securing boss 42 within the recess engages within a securing opening 94 (FIG. 4) in third leg 92. The third leg also has a downwardly depending tab 96 which is inserted into through passage 46 behind bottom ledge 44 at the bottom of recess 40. This structural combination not only fixes latching mechanisms 62 to the inner dielectric housing, but the structure is effective to anchor the entire shield 14, including interengaged shield halves 48 and 50, at the front of the connector.

As stated above, transverse second legs 88 of latching mechanisms 62 are confined for movement within slots 34 (FIG. 3) behind front walls 32 of inner dielectric housing 12. As seen in FIGS. 1, 2 and 6, outer dielectric cover 16 is provided with a fairly large opening 100 which is significantly larger than mating portion 24 of inner dielectric housing 12. Therefore, front walls 32 of the inner dielectric housing also are effective to close the opening in the outer cover to prevent unwarranted ingress to the interior of the connector. The opening in the outer cover must be large for assembly of all of the other components of the connector, including the entire shield 14, through the front of the outer cover.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

an inner dielectric housing adapted for mounting a plurality of electrical contacts and including a forwardly projecting mating portion having opposite sides;

a metallic shield surrounding a major portion of the inner dielectric housing and being formed by a pair of split shield halves, one of the shield halves including a generally L-shaped resilient latching mechanism at the front of the shield outside each opposite side of the mating portion of the inner dielectric housing, each of the L-shaped latching mechanisms including a front-to-rear first leg along a respective side of said mating portion and a transverse second leg projecting outwardly of the mating portion and extending generally perpendicular to the first leg, the first leg having an outwardly projecting latch portion; and an outer dielectric cover surrounding a major portion of the metallic shield and including a pair of actuators for engaging the second legs of the L-shaped latching mechanisms to urge the first legs and their latch portions inwardly toward each other and toward the mating portion of the inner dielectric housing.

2. The electrical connector of claim 1 wherein said outer dielectric cover is a unitary molded structure with said actuators being integral therewith.

3. The electrical connector of claim 1 wherein the front-to-rear first leg of each L-shaped latching mechanism is reverse bent to overlie a third leg secured to a respective side of the mating portion of the inner dielectric housing.

4. The electrical connector of claim 3 wherein the third legs of said latching mechanisms have securing openings for receiving securing bosses projecting outwardly from the opposite sides of said mating portions.

5. The electrical connector of claim 3 wherein the opposite sides of the mating portion of said inner dielectric housing have recesses within which the third legs of the latching mechanisms are nested.

6. The electrical connector of claim 5 wherein the third legs of said locking mechanisms have securing openings for receiving securing bosses projecting outwardly from the opposite sides of said mating portions.

7. The electrical connector of claim 1 wherein the transverse second leg of each L-shaped latching mechanism includes a hooked distal end for engagement by the actuator of the outer dielectric cover, the hooked distal end being engageable with a portion of the shield to prevent over-stressing the respective latching mechanism when the actuator urges the mechanism inwardly.

8. The electrical connector of claim 1 wherein the transverse second leg of each L-shaped latching mechanism is confined for movement in a slot in the inner dielectric housing.

9. The electrical connector of claim 1 wherein said outer dielectric cover has a front opening significantly larger than the mating portion of the inner dielectric housing, and the inner dielectric housing includes front walls projecting transversely outwardly of the mating portion to substantially close said front opening.

10. The electrical connector of claim 9 wherein the transverse second legs of said L-shaped latching mechanisms are confined for movement in slots behind the front walls of the inner dielectric housing.

11. An electrical connector, comprising:

an inner dielectric housing adapted for mounting a plurality of electrical contacts and including a forwardly projecting mating portion having opposite sides;

a metallic shield surrounding a major portion of the inner dielectric housing and being formed by a pair of split shield halves, one of the shield halves including a generally L-shaped resilient latching mechanism at the front of the shield outside each opposite side of the mating portion of the inner dielectric housing, each of the L-shaped latching mechanisms including a front-to-rear first leg along a respective side of said mating portion and a transverse second leg projecting outwardly of the mating portion, the first leg having an outwardly projecting latch portion and being reverse bent to overlie a third leg secured to a respective side of the mating portion of the inner dielectric housing;

an outer dielectric cover surrounding a major portion of the metallic shield and including a pair of actuators for engaging the second legs of the L-shaped latching mechanisms to urge the first legs and their latch portions inwardly toward each other and toward the mating portion of the inner dielectric housing, the cover being a unitary molded structure with said actuators being integral therewith; and said transverse leg of each L-shaped latching mechanism including a hooked distal end for engagement by the actuator of the outer dielectric cover, the hooked distal end being engageable with a portion of the shield to prevent over-stressing the respective latching mechanism when the actuator urges the mechanism inwardly.

12. The electrical connector of claim 11 wherein the opposite sides of the mating portion of said inner dielectric housing have recesses within which the third legs of the latching mechanisms are nested.

13. The electrical connector of claim 11 wherein the third legs of said locking mechanisms having securing openings for receiving securing bosses projecting outwardly from the opposite sides of said mating portions.

14. The electrical connector of claim 11 wherein the transverse second leg of each L-shaped latching mechanism is confined for movement in a slot in the inner dielectric housing.

15. The electrical connector of claim 11 wherein said outer dielectric cover has a front opening significantly larger than the mating portion of the inner dielectric housing, and the inner dielectric housing includes front walls projecting transversely outwardly of the mating portion to substantially close said front opening.

16. The electrical connector of claim 15 wherein the transverse second legs of said L-shaped latching mechanisms are confined for movement in slots behind the front walls of the inner dielectric housing.

17. An electrical connector, comprising:

an inner dielectric housing adapted for mounting a plurality of electrical contacts and including a forwardly projecting mating portion;

a metallic shield surrounding at least a portion of the inner dielectric housing and including a generally L-shaped resilient latching mechanism at the front of the shield adjacent the mating portion, the L-shaped latching mechanism including a front-to-rear first leg adjacent the mating portion and transverse second leg projecting outwardly of the mating portion and extending generally perpendicular to the first leg, the first leg having an outwardly projecting latch portion; and an outer dielectric cover surrounding at least a portion of the metallic shield and including an actuator for engaging the second leg of the L-shaped latching mechanism to urge the first leg and its latch portion inwardly toward the mating portion of the inner dielectric housing.

18. The electrical connector of claim 17 wherein said outer dielectric cover is a unitary molded structure with said actuator being integral therewith.

19. The electrical connector of claim 17 wherein the front-to-rear first leg of the L-shaped latching mechanism is reverse bent to overlie a third leg secured to the mating portion of the inner dielectric housing.

20. The electrical connector of claim 19 wherein the mating portion of said the inner dielectric housing has a recess within which the third leg of the latching mechanism is nested.

21. The electrical connector of claim 19 wherein the third leg of the latching mechanism has a securing opening for receiving a securing boss projecting outwardly from the mating portion.

22. The electrical connector of claim 17 wherein the transverse second leg of the L-shaped latching mechanism includes a hooked distal end for engagement by the actuator of the outer dielectric cover, the hooked distal end being engageable with a portion of the shield to prevent overstressing the latching mechanism when the actuator urges the mechanism inwardly.

23. The electrical connector of claim 17 wherein the transverse second leg of the L-shaped latching mechanism is confined for movement in a slot in the inner dielectric housing.

* * * * *